US007637586B2

(12) United States Patent
Yun

(10) Patent No.: US 7,637,586 B2
(45) Date of Patent: Dec. 29, 2009

(54) ARRAY TYPE INKJET PRINTER AND METHOD FOR DETERMINING CONDITION OF NOZZLES THEREOF

(75) Inventor: Young-jung Yun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 455 days.

(21) Appl. No.: 11/711,610

(22) Filed: Feb. 28, 2007

(65) Prior Publication Data

US 2008/0036803 A1 Feb. 14, 2008

(30) Foreign Application Priority Data

Aug. 14, 2006 (KR) ..... 10-2006-0076720

(51) Int. Cl.
*B41J 29/393* (2006.01)

(52) U.S. Cl. ..... 347/19; 347/13

(58) Field of Classification Search ..... 347/13, 347/19

See application file for complete search history.

(56) References Cited

U.S. PATENT DOCUMENTS

| | | | | |
|---|---|---|---|---|
| 2003/0001914 | A1* | 1/2003 | Matsumoto et al. | 347/12 |
| 2004/0090475 | A1* | 5/2004 | Ioka et al. | 347/5 |
| 2005/0062784 | A1* | 3/2005 | Matsuzaki et al. | 347/19 |
| 2006/0023018 | A1* | 2/2006 | Hatayama | 347/23 |
| 2007/0070102 | A1* | 3/2007 | Takata | 347/10 |

* cited by examiner

*Primary Examiner*—Julian D Huffman
(74) *Attorney, Agent, or Firm*—Stein McEwen, LLP

(57) ABSTRACT

An array type inkjet printer and a method of determining the condition of nozzles in the array type inkjet printer are disclosed. The array type inkjet printer includes a plurality of head chips, each comprising a plurality of nozzles, a print part which prints a plurality of test patterns of different forms, a scanning part which scans the plurality of printed test patterns, and a controller which controls the print part to print the plurality of test patterns using nozzles of interest among the plurality of nozzles, and determines the condition of the nozzles of interest with reference to a certain part of an image of the scanned test patterns. Accordingly, nozzle information is easily determined.

20 Claims, 10 Drawing Sheets

ARRAY TYPE INKJET PRINTER AND METHOD FOR DETERMINING CONDITION OF NOZZLES THEREOF

CROSS-REFERENCE TO RELATED APPLICATIONS

This application claims the benefit of Korean Application No. 2006-76720, filed Aug. 14, 2006, in the Korean Intellectual Property Office, the disclosure of which is incorporated herein by reference.

BACKGROUND OF THE INVENTION

1. Field of the Invention

Aspects of the present invention relate to an array type inkjet printer and a method of determining the condition of nozzles in the array type inkjet printer. More particularly, aspects of the present invention relate to an array type inkjet printer which determines the condition of the nozzles using a plurality of patterns and a method of determining the condition of nozzles in the array type inkjet printer.

2. Description of the Related Art

Inkjet printers eject ink on a print medium (e.g., paper, transparency, or film) through nozzles according to a control signal. Inkjet printers are divided into shuttle type inkjet printers and array type inkjet printers according to ways that the print heads of the inkjet printers are driven.

Pluralities of nozzles in shuttle type inkjet printers are disposed in a print head in a sub-scanning direction. The head travels in a main scanning direction to print one line and travels in a sub-scanning direction to print another line. Nozzles in array type inkjet printers are disposed in the main scanning direction of the print head, print line by line in a sub-scanning direction and a print medium is moved in the sub-scanning direction.

The print head of both types of inkjet printers has a plurality of nozzles disposed thereon. If nozzles are clogged or do not operate due to a malfunction of a power supplying circuit connected to the nozzles, dead nozzles are generated. Accordingly, the image quality of the printed output degrades.

Therefore, a method of compensating for dead nozzles is required. As an example, a method of detecting and compensating for the detected dead nozzles exists. This method uses an optical sensor attached to a carriage that travels in a main scanning direction while being mounted on an ink cartridge. An inkjet printer adopting this method includes a carriage module to move the ink cartridge to a particular place at a particular speed using an encoder. The inkjet printer further includes a line movement module to move the print medium to a particular place at a particular speed.

Accordingly, the head with the plurality of nozzles disposed thereon prints particular patterns at particular places using the carriage module and the line movement module, senses the patterns by the optical sensor at the particular place, and determines if the patterns are appropriately printed through the level of the sensed patterns. The head can then, accordingly, determine if the nozzles used to print the patterns are operating normally or abnormally.

The above method of determining the condition of the nozzles using the optical sensor attached to the carriage is effective in determining the condition of the nozzles. However, if there is no carriage to which an optical sensor may be attached, this particular method cannot be applied.

The head of the array type inkjet printer may include thousands of nozzles according to a resolution or design thereof. For the purpose of convenience of explanation, it is assumed that 1200 nozzles are formed for one line. As a color inkjet printer supports four colors of cyan, magenta, yellow, and black (CMYK), the head is understood to have 4,800 (1,200×4=4,800) nozzles.

Accordingly, the above method of determining the condition of the nozzles using the optical sensor attached to the carriage cannot be used in array type inkjet printers which have no carriage and which have thousands of nozzles disposed in the print head.

SUMMARY OF THE INVENTION

An aspect of embodiments of the present invention is to solve the above and/or other problems and/or disadvantages and to provide the advantages described below and/or other advantages. Accordingly, an aspect of embodiments of the present invention is to provide an array type inkjet printer which determines the condition of nozzles by determining the beginning location for an image using various test patterns and a method of determining the condition of the nozzles in the array type inkjet printer.

In order to achieve the above-described and/or other aspects of embodiments of the present invention, an inkjet printer is provided, comprising a plurality of head chips, each comprising a plurality of nozzles; a print part which prints a plurality of test patterns of different forms; a scanning part which scans the plurality of printed test patterns; and a controller which controls the print part to print the plurality of test patterns using nozzles of interest from among the plurality of nozzles, and which determines the condition of the nozzles of interest with reference to a certain part of the scanned test patterns.

The plurality of test patterns comprises a first test pattern comprising a plurality of vertical lines separated by a first constant interval, a second test pattern comprising a horizontal pattern and a vertical pattern, the horizontal pattern comprising a plurality of horizontal lines, and the vertical pattern formed below the horizontal pattern and comprising a plurality of vertical lines by a second constant interval, the combination of the horizontal pattern and the vertical pattern repeating as many times as a length of the second interval; and a third test pattern comprising a plurality of vertical lines separated by the first constant interval, and formed to a side of the second test pattern.

The controller controls the print part to print the first test pattern using nozzles of the plurality of head chips, and then prints the second and the third test patterns below the first test pattern using nozzles of a pair of neighboring head chips.

The controller controls the print part to print the first test pattern by repeatedly using a center nozzle and two nozzles on either side of the center nozzle separated from the center nozzle by intervals having lengths which are substantially equal to a number of the plurality of head chips, and to print the second test pattern by using the plurality of head chips in turn in which the horizontal pattern is printed first by using all the nozzles of the used head chips, and the vertical pattern is then printed by using the nozzles at intervals which are positioned below the horizontal pattern, and to print the third test pattern simultaneously with the printing of the second test pattern, by using the head chips which are not used in the printing of the second test pattern, and by using the nozzles located at positions that correspond to those of the nozzles used in the printing of the first test pattern.

The plurality of test patterns further comprises a fourth test pattern comprising a horizontal line which is formed by using color nozzles provided to the plurality of the head chips.

The plurality of test patterns further comprises a fifth test pattern comprising a square which is formed by using a center nozzle and nozzles separated by predetermined distances from the center nozzle of the plurality of the head chips.

The controller measures a distance between lines of one head chip using the first test pattern of the scanned test patterns, determines a scan rate based on the measured distance between the lines of one head chip, and determines a beginning location of the lines based on the determined scan rate.

The controller detects the lines of the first test pattern within a line recognition range, determines a position mode based on the detected lines, determines location of centers of the head chips based on the position mode, and measures distance a between the head chips using the centers of the head chip and another head chip. The position mode comprises a center mode, a left mode and a right mode.

The controller determines an operational status of the nozzles of interest using a level value of the plurality of nozzles when the image of the scanned test pattern is moved from the beginning location.

The controller determines the operational status of the nozzles of interest by determining whether the vertical pattern within a range of the beginning location and a reference location is printed.

In order to achieve the above-described and/or other aspects of embodiments of the present invention, a method of determining conditions of nozzles to eject ink toward a print medium in an array type inkjet printer comprising a plurality of head chips on which the nozzles are disposed is provided, the method comprising printing a plurality of different test patterns; scanning the plurality of printed test patterns; and determining the condition of nozzles of interest with reference to a certain part of the scanned printed test patterns.

The plurality of test patterns comprises a first test pattern comprising a plurality of vertical lines separated by a first constant interval; a second test pattern comprising a horizontal pattern and a vertical pattern, the horizontal pattern comprising a plurality of horizontal lines, and the vertical pattern formed below the horizontal pattern and comprising a plurality of vertical lines separated by a second constant interval, the combination of the horizontal pattern and the vertical pattern repeating as many times as a length of the second interval; and a third test pattern comprising a plurality of vertical lines separated by the first constant interval, and formed to a side of the second test pattern.

The printing of the plurality of test patterns comprises printing the first test pattern using the nozzles of the plurality of head chips; and printing the second and the third test patterns below the first test pattern using the nozzles of a pair of neighboring head chips.

The printing of the plurality of test patterns comprises repeatedly printing the first test pattern by using a center nozzle and two nozzles on either side of the center nozzle separated from the center nozzle by intervals having lengths substantially equal to a number of the plurality of head chips; and printing the second test pattern by using the plurality of head chips in turn in which the horizontal pattern is printed first by using all the nozzles of the used head chips. The vertical pattern is then printed using the nozzles at intervals which are positioned below the horizontal pattern. The third test pattern is simultaneously printed along with the second test pattern by using the head chips which are not used in the printing of the second test pattern and by using the nozzles at locations that correspond to the locations of the nozzles used in the printing of the first test pattern.

The plurality of test patterns further comprises a fourth test pattern comprising a horizontal line which is formed by using color nozzles provided to the plurality of the head chips.

The plurality of test patterns further comprises a fifth test pattern comprising a square which is formed by using a center nozzle and nozzles separated by predetermined distances from the center nozzle of the plurality of the head chips.

The determining of a beginning location of the test patterns, comprises measuring a distance between lines of one head chip using the first test pattern of the scanned test patterns; determining a scan rate based on the measured distance between the lines of one head chip; and determining the beginning location based on the determined scan rate.

The measuring of the distance between the lines of one head chip comprises detecting the lines of the first test pattern within a line recognition range; determining a position mode based on the detected lines; determining centers of the head chips based on the position mode; and measuring a distance between the head chips using the centers of the head chip and another head chip. The position mode comprises a center mode, a left mode and a right mode.

The determining of the condition of the nozzles of interest comprises determining an operational status of the nozzles of interest using a level value of the plurality of nozzles, when the image of the scanned test pattern is moved from the beginning location.

The determining of the condition of the nozzles of interest comprises determining the operational status of the nozzles of interest by determining whether the vertical pattern within a range of the beginning location and a reference location are printed.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
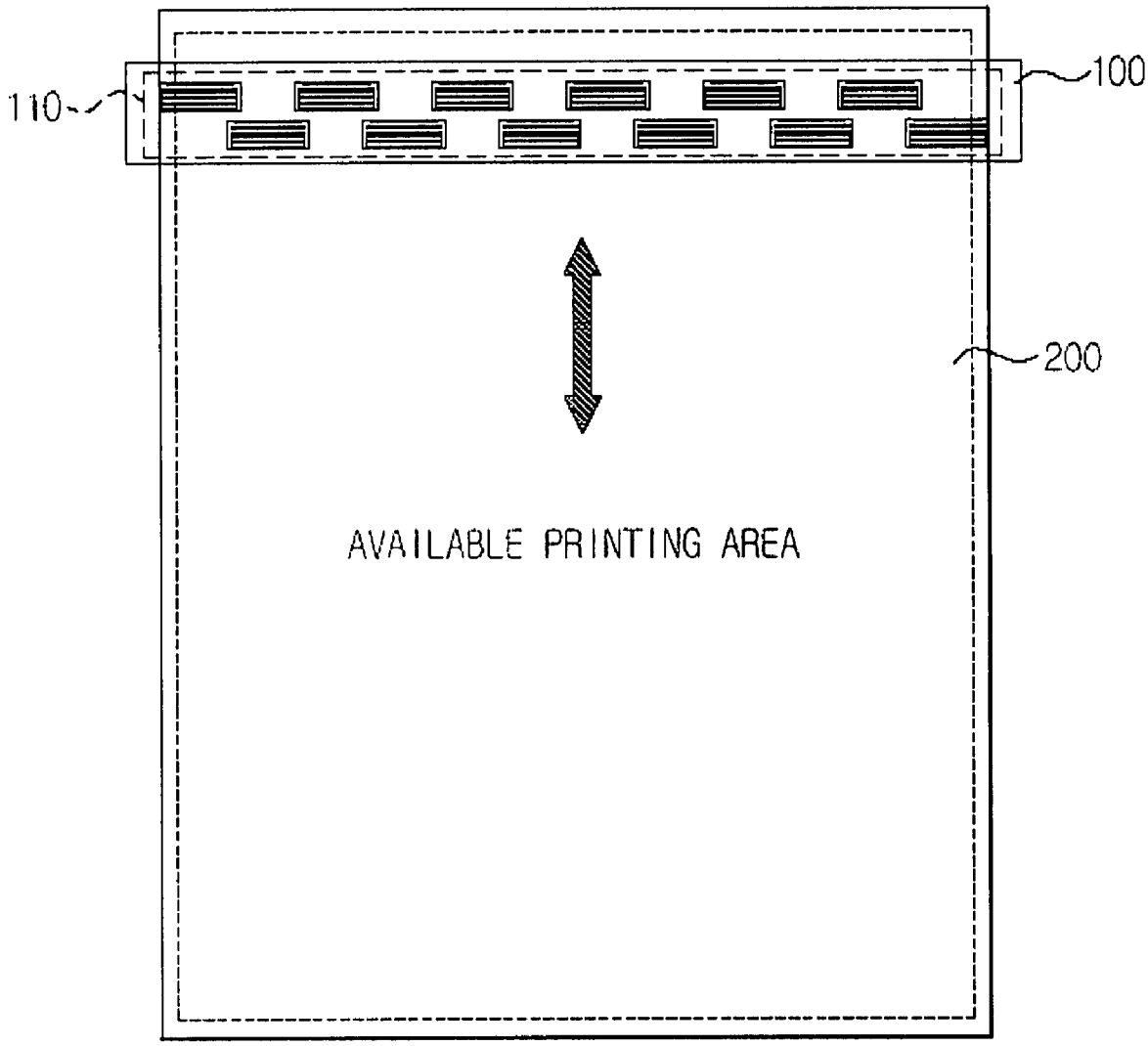
FIG. 1 shows the configuration of a head of an array type inkjet printer according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 shows the configuration of a head of an array type inkjet printer according to an embodiment of the present invention. As shown in FIG. 1, a head cartridge 100 of an array type inkjet printer has a plurality of head chips 110 which are alternately arranged in two lines along a main scanning direction. Additionally, each of the head chips 110 has a plurality of nozzles disposed thereon. If the printer is a color array type inkjet printer, a plurality of nozzles for each of the colors such as cyan, magenta, yellow and black are additionally formed.

As further shown in FIG. 1, the head cartridge 100 of the array type inkjet printer has a length, in a main scanning direction, which is longer than the width of a print medium 200. As such, in the array type inkjet printer, the head cartridge 100 does not have to move while the print medium 200 alone moves in the direction illustrated by the arrow during printing operations.

Figure 2:
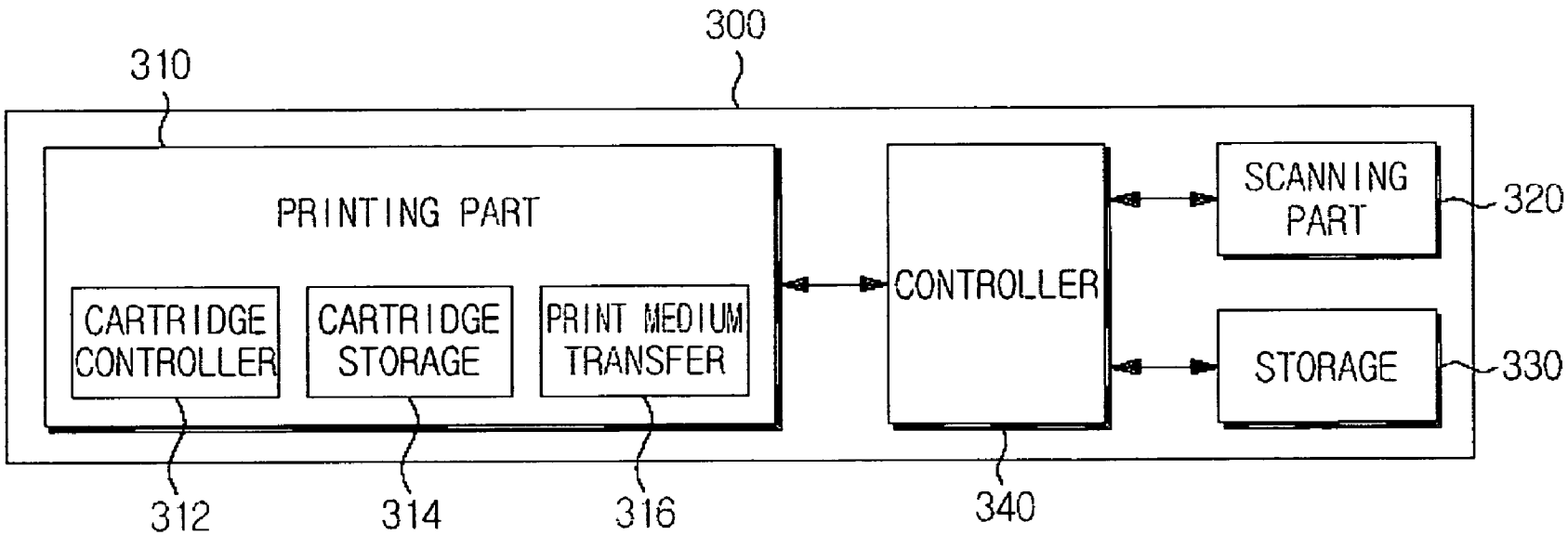
FIG. 2 is a block diagram of an array type inkjet printer according to an embodiment of the present invention.

FIG. 2 is a block diagram of an array type inkjet printer according to an embodiment of the present invention. As shown in FIG. 2, the array type inkjet printer 300, according to an embodiment of the present invention, includes a printing part 310, a scanning part 320, a storage 330, and a controller 340.

The printing part 310 prints a plurality of test patterns having different forms while being operated by the controller 340. The plurality of test patterns will be described in greater detail with reference to FIG. 3 below. According to an aspect of the invention, the printing part 310 may include a cartridge controller 312, a cartridge storage 314 and a print medium transfer 316. The cartridge controller 312 directly controls the head cartridge 100 shown in FIG. 1 by the operation of the controller 340. That is, the cartridge controller 312 operates the corresponding head chip 110 or corresponding nozzles to perform printing. The cartridge storage 314 may be a memory mounted in the head cartridge 100 and may store information provided from the controller 340 (e.g., a level value of a nozzle). The cartridge storage 314 may be implemented with a buffer, parts of which are allocated to each nozzle.

The print medium transfer 316 transfers the print medium 200 in order for the head cartridge 100 to perform printing operations. The print medium 200 is moved in the direction of the arrow illustrated in FIG. 1 by the print medium transfer 316 while printing operations are performed. The scanning part 320 scans the plurality of test patterns printed on the print medium 200. The storage 330 stores the plurality of test patterns to be printed. The storage 330 may also store intervals among the test patterns when the controller 340 operates the printing unit 310 to print the test patterns. Additionally, the storage 330 may store a reference value that the controller 340 uses to determine the condition of nozzles using level values of the nozzles.

The controller 340 operates the overall functions of the array type inkjet printer 300. That is, the controller 340 controls an input and/or output of signals to and/or from the printing part 310, scanning part 320 and storage 330. The controller 340 also operates the printing part 310 to print the plurality of test patterns using the nozzles disposed in the head chips 110 of the head cartridge 100 to detect the nozzles. In addition, the controller 340 operates the scanning part 320 to scan the print medium 200 bearing the test patterns once the printing part 310 finishes printing the test patterns onto the print medium 200.

The controller 340 then determines the beginning location for the image of the scanned test patterns once the scanning part 320 scans the test patterns, and determines the operational state of the nozzles to detect based on the beginning location. The manner of determining the condition of the nozzles to detect in the controller 340 will be described in greater detail later with reference to FIGS. 6-9.

Figure 3:
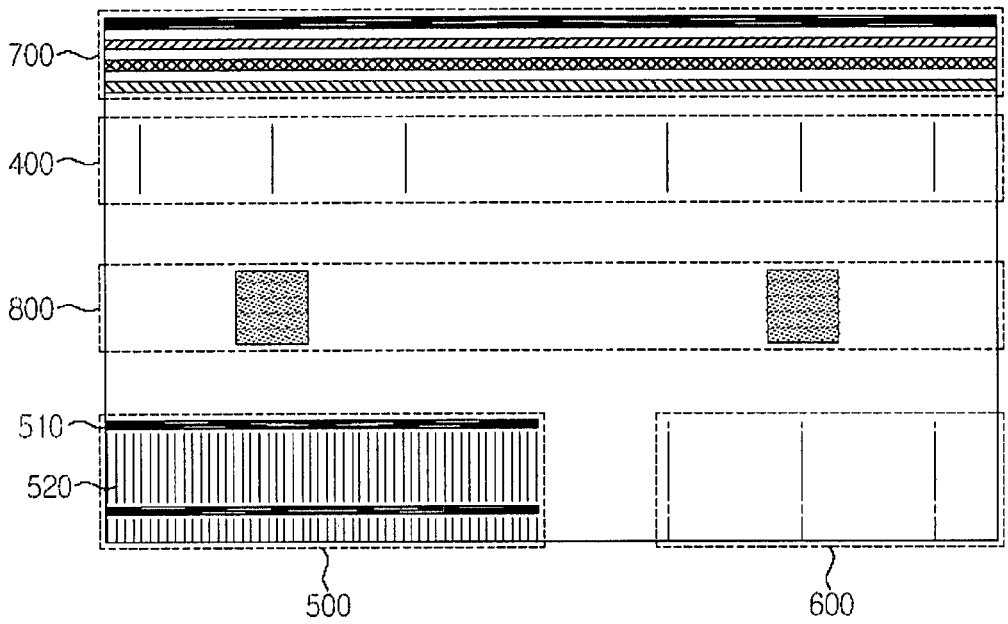
FIG. 3 shows various test patterns according to an embodiment of the present invention.

FIG. 3 shows various test patterns according to an embodiment of the present invention. As shown in FIG. 3, the test patterns to determine the condition of the nozzles include first to fifth test patterns 400-800 each of which has a different format. The first test pattern 400 has a plurality of vertical lines which are spaced from each other. The first test pattern 400 includes three lines from each head chip 110 and is a pattern to allow for a measurement of the distance between two adjacent head chips 110 and the scanning magnification. Desirably, the three lines of the first test pattern can be printed by nozzles corresponding to ¼, ⅔, and ¾ locations of a head chip 110.

A manner of measuring the distance between the chips using the first test pattern 400 will be described in greater detail with reference to FIG. 4. The plurality of head chips 110 in the head cartridge 100 are theoretically designed to be spaced from each other at regular intervals, but the real interval might be different from the theoretical interval. Accordingly, in the present embodiment, the accurate distance between the head chips 110 will be measured using the first test pattern 400. To print the first test pattern 400, the controller 340 controls the printing part 310 to operate a center nozzle and two nozzles, the two nozzles being equally spaced from the center nozzle in the both directions and from each head chip 110. The three nozzles repeatedly operate and form the first test pattern 400.

The second test pattern 500 includes a horizontal pattern 510 which has horizontal lines and a vertical pattern 520 which has vertical lines spaced from each other under the horizontal pattern 510. Where the first test pattern 400 includes three lines per each head chip 110, the vertical pattern 520 of the second test pattern 500 has more lines at finer intervals than the first test pattern 400. To print the second test pattern 500, the controller 340 controls the printing part 310 to alternately operate the plurality of head chips 110. That is, the nozzles of only certain head chips 110 are repeatedly operated a certain number of times such that the horizontal pattern 510 is printed. In addition, the controller 340 controls the printing part 310 to repeatedly operate nozzles which are regularly spaced from one another under the horizontal pattern 510 a certain number of times such that the vertical patterns 520 are printed.

The controller 340 repeats the operation of the nozzles a certain number of time and thereby prints the horizontal pattern 510 and vertical pattern 520. The certain number of times is similar to the length of the intervals between the nozzles used to form the vertical pattern 520. For example, if the nozzles forming the vertical pattern 520 are spaced from each other by 12 spaces, the horizontal pattern 510 and vertical pattern 520 are repeated 12 times. Moreover, whenever the horizontal pattern 510 and vertical pattern 520 are repeated, the intervals between the vertical patterns 520 are the same but the location of nozzles to form each line changes. Here, in accordance with an embodiment of the invention, a nozzle next to the nozzle used to form the previous vertical pattern 520 is used to form the present vertical pattern 520.

The second test pattern 500 repeats the horizontal pattern 510 and vertical patterns 520 a certain number of times to effectively detect dead nozzles from all nozzles. The second test pattern 500 will be described in greater detail with reference to FIGS. 5A and 5B later.

The third test pattern 600 includes vertical lines having the same intervals as portions of the first test pattern 400 and is illustrated as being positioned beside the second test pattern 500. That is, if the second test pattern 500 is printed using the nozzles of the first head chip 110, the third test pattern 600 is printed using the nozzles of the second head chip 110. Such a manner is applied to all the head chips 110. To print the third test pattern 600, the controller 340 controls the printing part 310 to use a head chip 110 which was not used when printing the second test pattern 500 and to use the nozzles used when printing the first test pattern 400.

As shown in FIG. 3, the third test pattern 600 includes dotted lines unlike the lines of the first test pattern 400. This is because the third test pattern 600 and second test pattern 500 are simultaneously printed such that intervals between the horizontal pattern 510 and vertical pattern 520 are formed.

The fourth test pattern 700 includes horizontal lines of a certain width formed by all nozzles of all colors in the plurality of the head chips 110. If the array type inkjet printer 300 is a color printer, the head chip 110 generally includes nozzles for cyan, magenta, yellow and black colors. Accordingly, the fourth test pattern 700 includes strips of four colors.

The fourth test pattern 700 aims at color correction when the scanning part 320 performs scanning. Colors may be corrected by adjusting a scale of the scanning part 320 according to the scanned scale. For example, if the scale of the fourth test pattern 700 printed on the print medium 200 is determined to 80%, the scale of the scanning part 320 may be adjusted to 100%. Therefore, clearer images may be achieved when subsequently performing scanning.

The fifth test pattern 800 includes quadrangles formed using a center nozzle of each head chip 110 and nozzles adjacent to the center nozzle. The square fifth test pattern 800 is illustrated in FIG. 3 but other quadrangular shapes such as rectangular may be applied. The fifth test pattern 800 is used when a distance between the head chips 110 cannot be determined using the first test pattern 400. Using the fifth test pattern 800, the distance between the head chips 110 may be measured using a distance between the center of one rectangle and the center of an adjacent rectangle.

As noted above, FIG. 3 illustrates a part of a plurality of test patterns printed on the print medium 200. That is, FIG. 3 illustrates a plurality of test patterns printed by two adjacent head chip 110. Accordingly, the test patterns of FIG. 3 are repeated corresponding to the location of all head chips 110. The first to fifth test patterns 400-800 are printed in a certain order, and not at the same time. As shown in FIG. 3, the fourth test pattern 700 is printed first, and then the first test pattern 400 is printed under the fourth test pattern 700 by moving the print medium 200. Subsequently, after the print medium 200 is moved again, the fifth test pattern 800 is printed under the first test pattern 400. Again, the print medium 200 is again moved, and the second and third test patterns 500 and 600 are printed.

Figure 4:
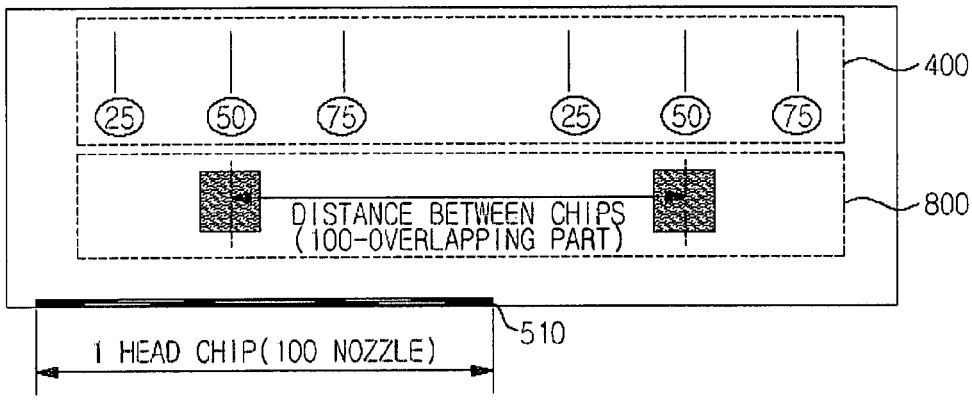
FIG. 4 shows a method for measuring the distance between chips using a test pattern.

FIG. 4 shows a method for measuring the distance between chips using the test pattern and illustrates a part of the plurality of test patterns of FIG. 3. Here, it is assumed that one head chip 110 has 100 nozzles and $25^{th}$, $50^{th}$ and $75^{th}$ nozzles in each head chip 110 are used to print the first test pattern 400.

The controller 340 determines a position mode of a recognized line in the first test pattern 400 within a preset line recognition range. There are a center mode, a left mode and a right mode for the position modes of a line. The line recognition range may be set as a range corresponding to one head chip 110. It is assumed that the line printed by the $25^{th}$ nozzle is the left mode, the line printed by the $50^{th}$ nozzle is the center mode and the line printed by the $75^{th}$ nozzle is the right mode. After the position modes of the lines are determined, the controller 340 measures the distance between the chips by measuring a distance between the line of the center mode in the first line recognizing range and the line of the center mode in the second line recognizing range. Thus, if it is assumed that one head chip 110 includes 100 nozzles, a distance between chips theoretically equals a 100-overrapped part. As shown in FIG. 1, the head chip 110 has a part that overlaps with the head chips 110 on both sides.

In accordance with an embodiment of the invention, the practical distance between the head chips 110 should be substantially equal to the theoretical distance between the head chips 110. However, there may be an error between the practical distance and the theoretical distance. Accordingly, the practical distance between lines of the head chips 110 may be measured by determining the center of the chips from the first test pattern 400. The controller 340 then determines the scanning magnification by the distance between lines of the head chips 110. The scanning magnification is the practical distance between lines of one head chip 110 and the theoretical distance between lines of one head chip 110.

Figure 5A:
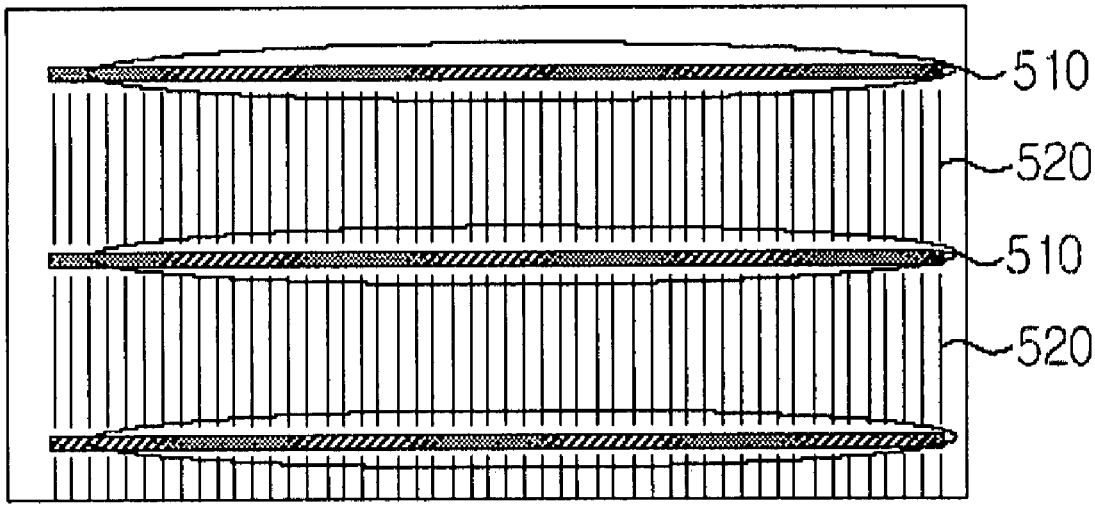
FIGS. 5A and 5B are detailed views of the second test pattern shown in FIG. 3.
Figure 5B:
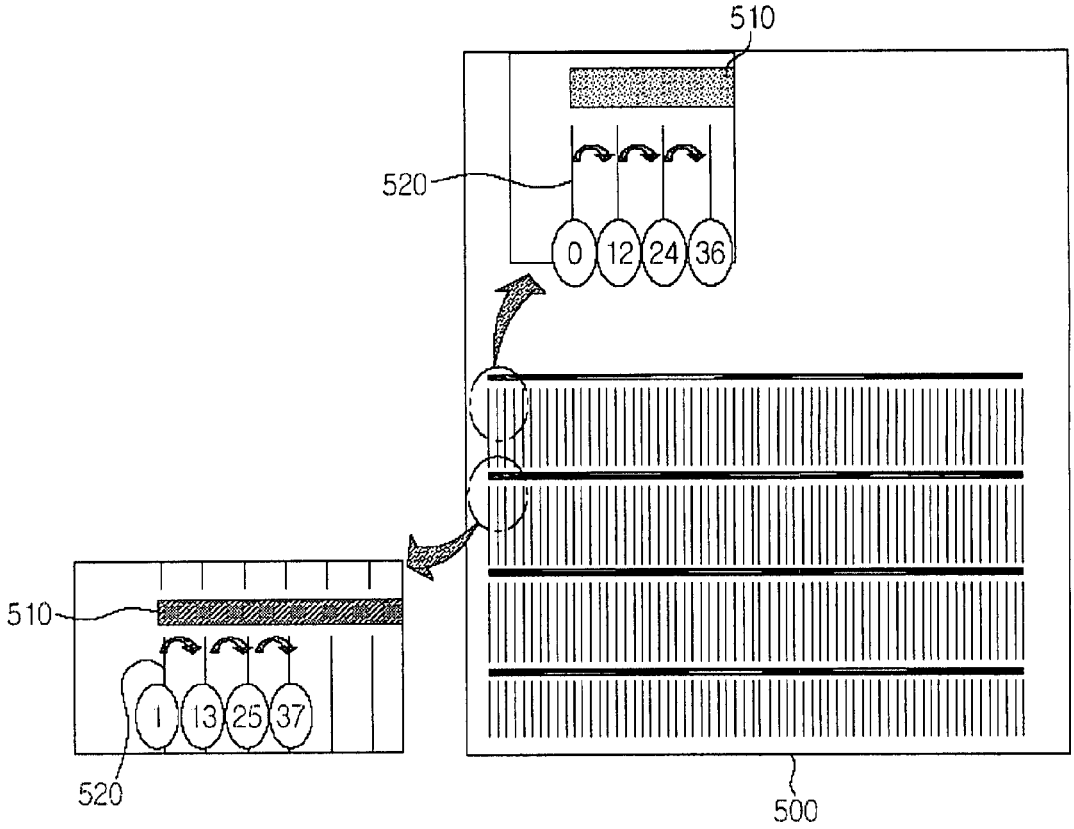

FIGS. 5A and 5B are detailed views of the second test pattern shown in FIG. 3. As shown in FIG. 5A, if the interval of nozzles printing the vertical pattern 520 is 12, the horizontal pattern 510 and vertical pattern 520 have to be repeated 12 times. Of course, it is understood that, since only a part of the second test pattern 500 is illustrated in FIG. 5A, the horizontal pattern 510 refreshes all nozzles before printing the vertical pattern 520. As shown in FIG. 5B, when forming the vertical pattern 520 under the horizontal pattern 510, if a first vertical pattern 520 is formed by the $0^{th}$, $12^{th}$, $24^{th}$, $36^{th}$ . . . nozzles, a second vertical pattern 520 is formed by the $1^{th}$, $13^{th}$, $25^{th}$, $37^{th}$ . . . nozzles.

Figure 6:
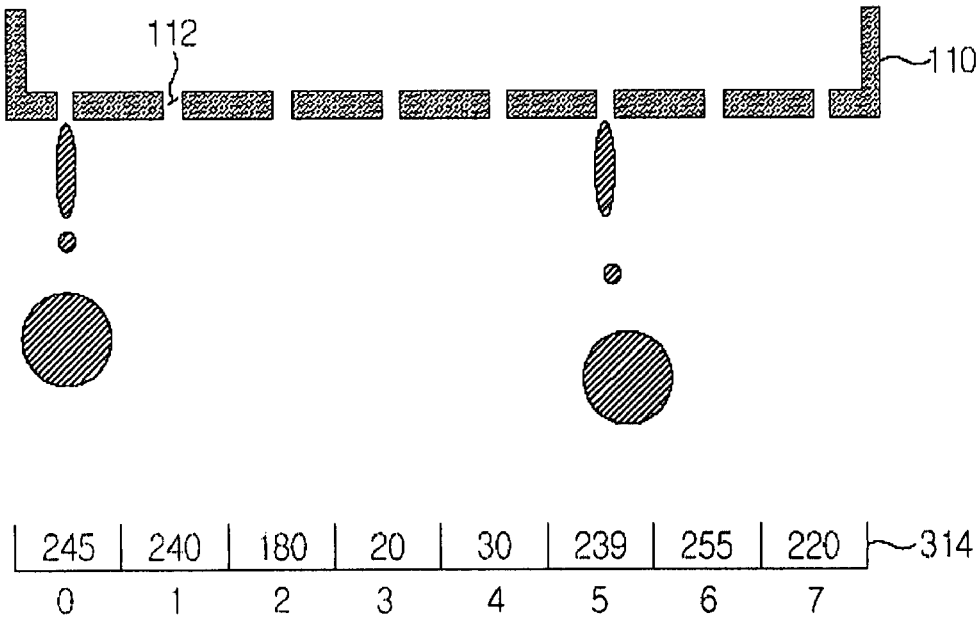
FIG. 6 shows the stored state of nozzle information.

FIG. 6 shows the stored state of nozzle information. As shown in FIG. 6, it is assumed that one head chip 110 has 8 nozzles 112 and that ink is ejected from 0th and 5th nozzles 112. After a plurality of test patterns are printed using the nozzles 112, the level of each nozzle 112 is recognizable by scanning. If the level of each nozzle 112 is recognized by the controller 340, the levels are stored in a corresponding part of the cartridge storage 314.

Figure 7:
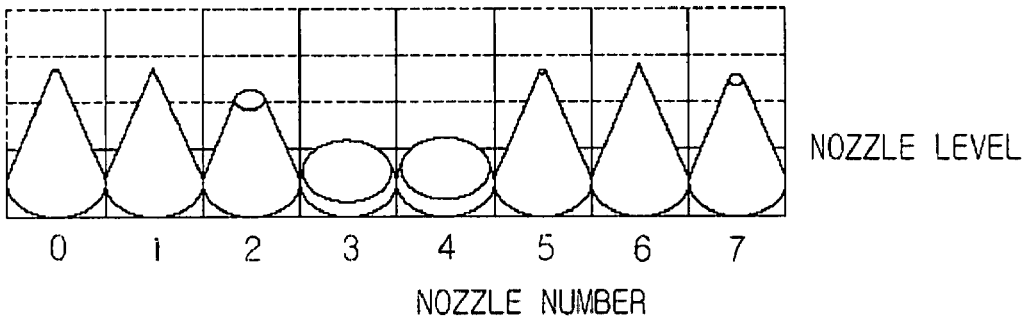
FIG. 7 shows a method of determining the condition of nozzles according to nozzle levels according to a first embodiment of the present invention.

FIG. 7 shows a method of determining the condition of nozzles according to the nozzle levels according to a first embodiment of the present invention and is a graph showing the nozzle levels that are stored in the cartridge storage 314 of FIG. 6. As shown, the zeroth through the second nozzles 112 are understood as being able to print stably. However, the 3rd and 4th nozzles 112 each has a level that is below a preset reference level. The controller 340 then determines that the 3rd and 4th nozzles 112 are dead nozzles.

However, if the 3rd and the 4th nozzles 112 are determined to be dead nozzles, those nozzles are not used any more even though the $3^{rd}$ and $4^{th}$ nozzles may not be completely dead. That is, if the $3^{rd}$ and $4^{th}$ nozzles are operated during a printing operation, normal printing may be achievable. Therefore, the $3^{rd}$ and $4^{th}$ nozzles should not necessarily be determined to be dead nozzles.

Figure 8:
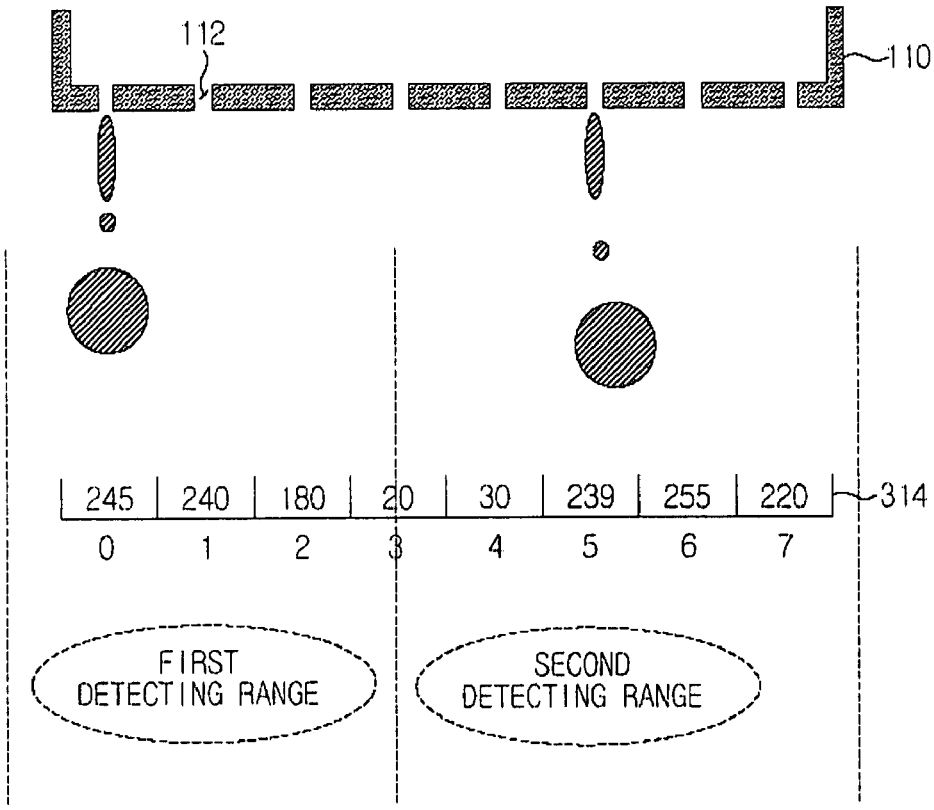
FIG. 8 shows a method of determining the condition of nozzles according to nozzle levels according to a second embodiment of the present invention.
Figure 9:
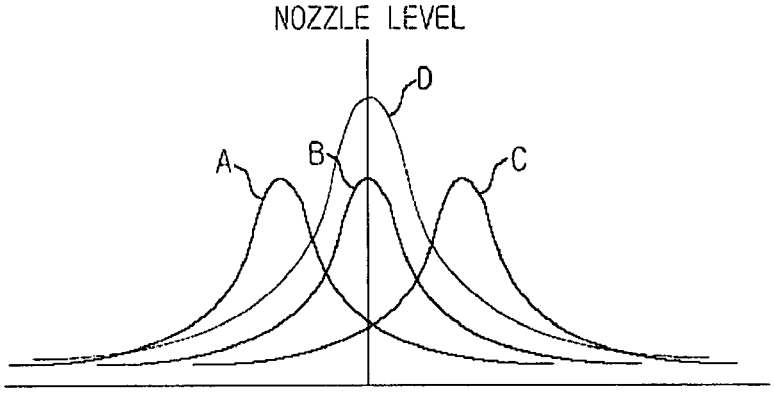
FIG. 9 is a graph showing nozzle information detected in FIG. 8.

FIG. 8 shows a method of determining the condition of nozzles according to nozzle levels in accordance with a second embodiment of the present invention and FIG. 9 is a graph showing nozzle information detected in FIG. 8. In FIG. 8, a plurality of nozzles 112 in one head chip 110 have the same level as the nozzles of the first embodiment of FIG. 7. In this embodiment, however, a region corresponding to one head chip 110 is segmented at regular intervals to detect dead nozzles. Then, as shown in FIG. 9, nozzles corresponding to A, B and C are shown to have similar levels, and a nozzle corresponding to D is shown to have the highest level.

Figure 10:
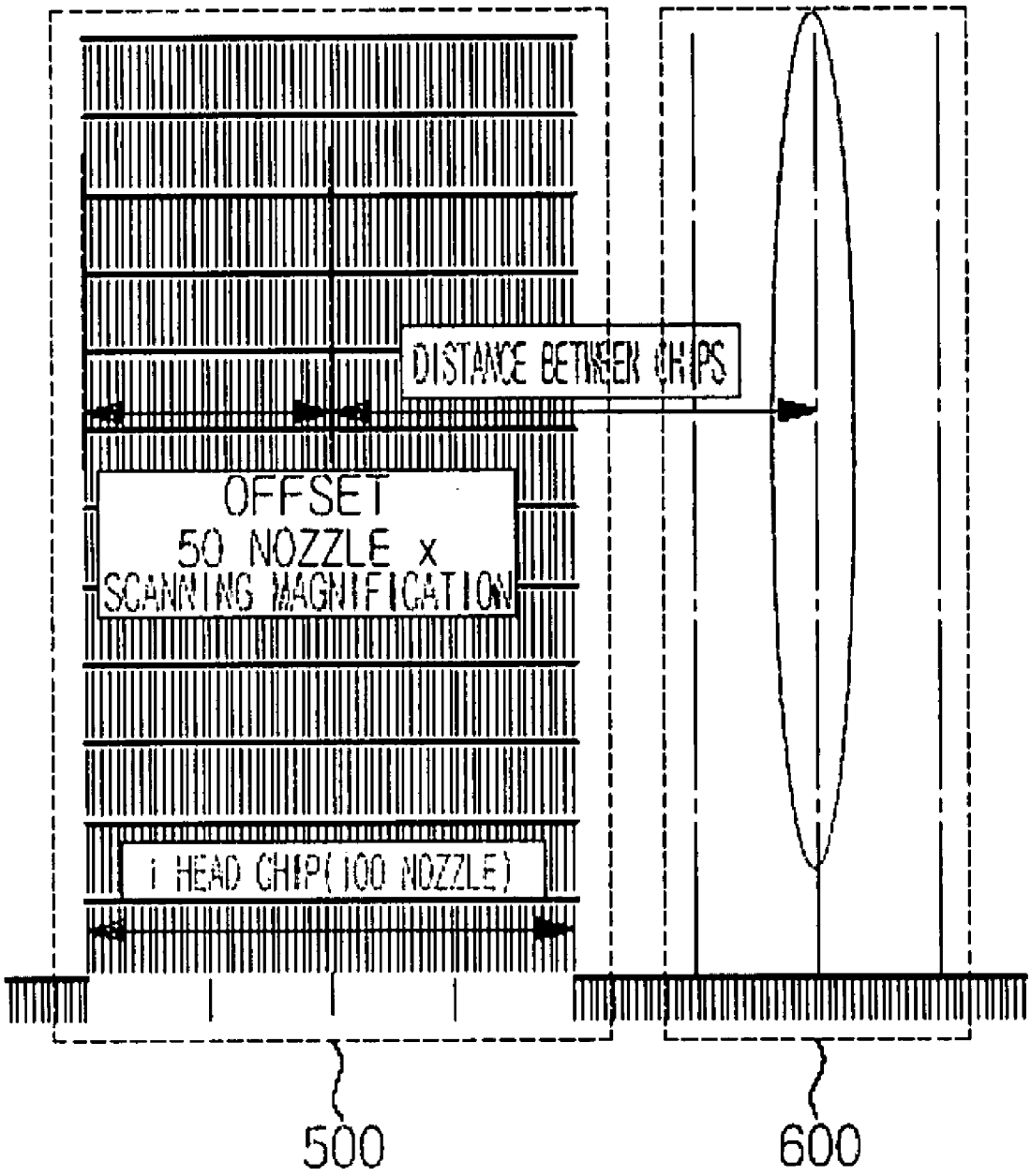
FIG. 10 shows a method of determining the beginning location for an image.

FIG. 10 illustrates a method of determining the beginning location for an image. With reference to FIG. 10, the beginning location for an image is determined using, for example, the second test pattern 500 and the third test pattern 600. If one head chip 110 has 100 nozzles 112, as shown in FIG. 4, and nozzles between a chip and a next chip overlap with each other, the distance between chips is 95 (100−5) units.

The controller 340 determines the beginning location to be where a distance is moved from the center line of the third test pattern 600 toward the second test pattern 500 by as much as a pre-measured distance between chips and by the distance that the theoretical offset distance (50 nozzles×the scanning magnification) is moved.

Figure 11:
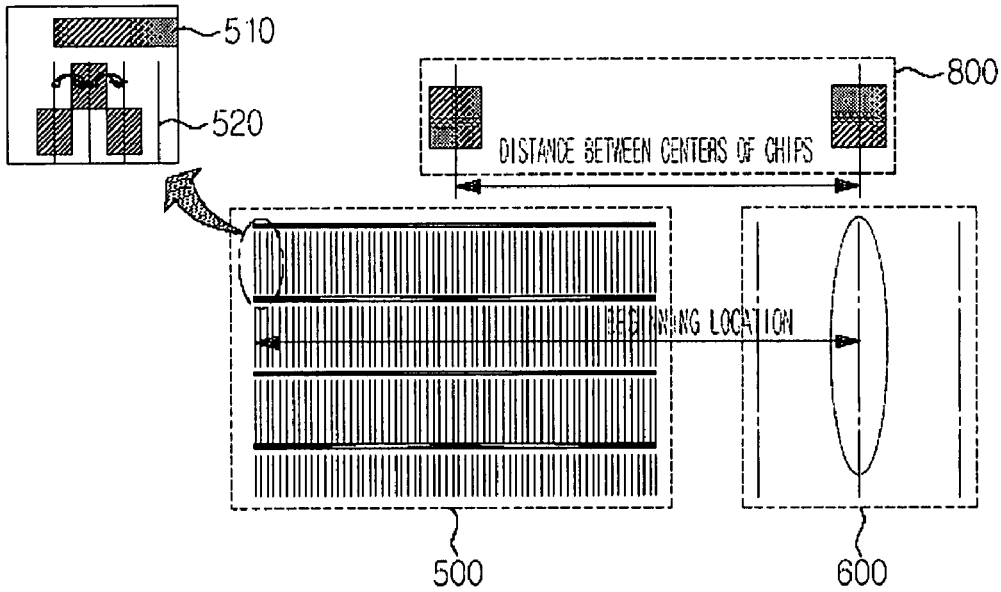
FIG. 11 shows setting a searching range when detecting dead nozzles using the second test pattern.

FIG. 11 illustrates the setting of a detecting range when detecting dead nozzles using, for example, the second test pattern 500. In FIG. 11, a part of the second test pattern 500 is enlarged. Referring to the enlarged part, a certain range of each line of the vertical pattern 520 is set as the detecting range. If there is line information within the detecting range, the corresponding nozzle is determined to be operating normally. Meanwhile, if there is no line information within the detecting range, the corresponding nozzle is determined to not be operating normally.

Figure 12:
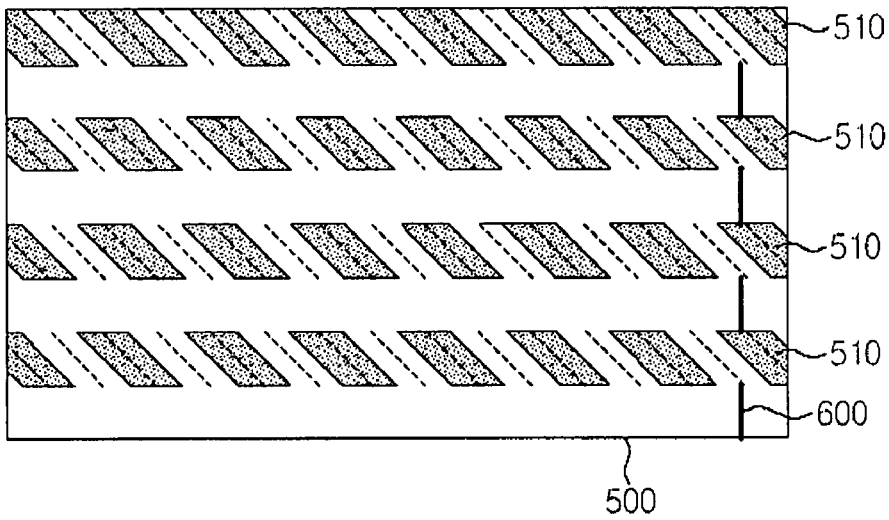
FIG. 12 shows the searching range of FIG. 11 in greater detail.

FIG. 12 shows the detecting range of FIG. 11 in greater detail. As is described above, in the second test pattern 500, the horizontal pattern 510 and vertical pattern 520 are repeated a number of times that is equal to the number of spaces in the interval between the nozzles 112 forming the vertical pattern 520. Accordingly, if the interval of the nozzles to form the vertical pattern 520 is 12 spaces, the horizontal pattern 510 and vertical pattern 520 are repeated 12 times. The vertical pattern 520 of the second test pattern 500, being repeated 12 times, is shown in FIG. 12. Here, since the location of the nozzles forming the vertical patterns 520 changes by 1 after each iteration of the pattern, the lines form an oblique line. Therefore the detecting range is repeated.

Figure 13:
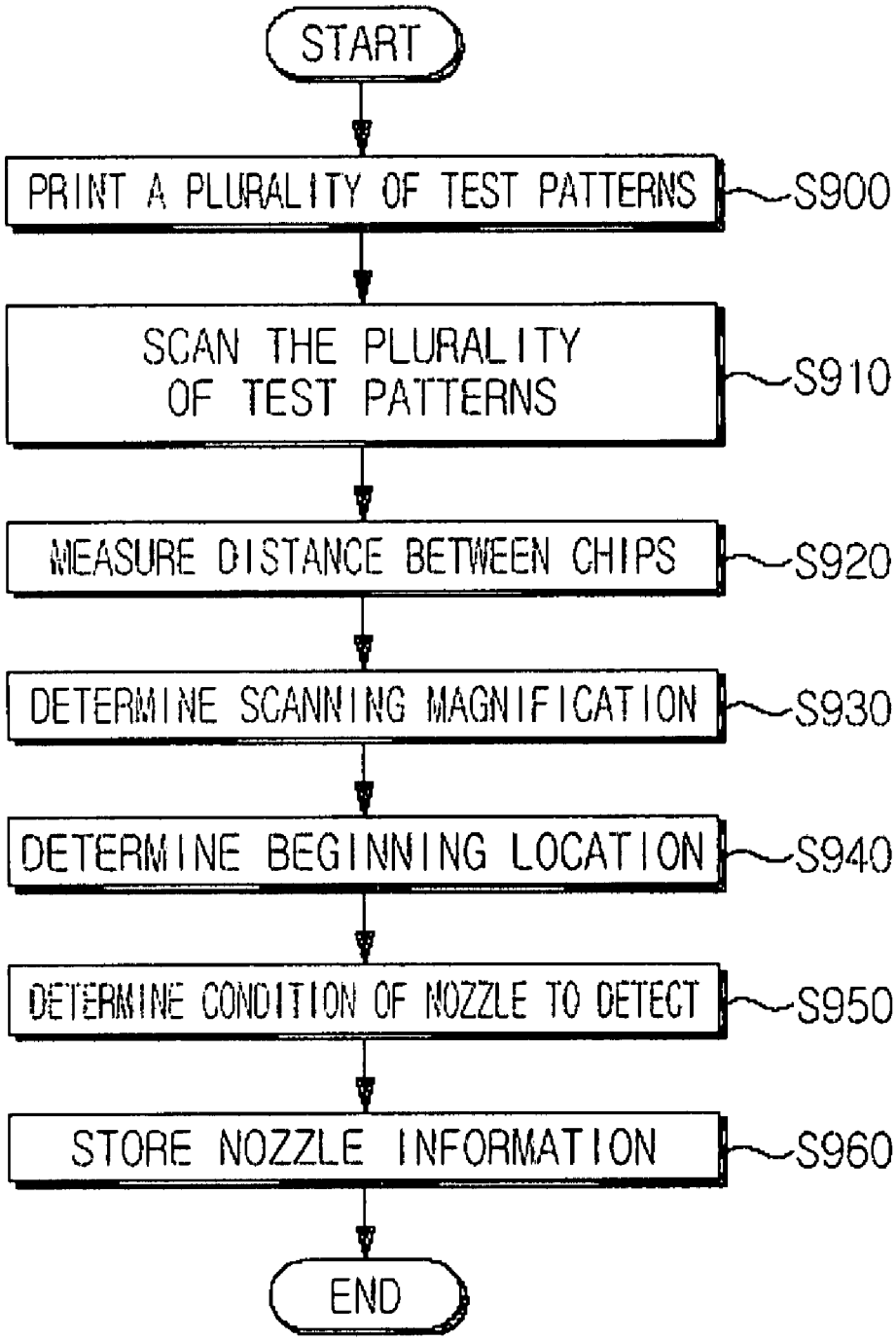
FIG. 13 is a flow chart showing a method of determining the condition of the nozzles in an array type inkjet printer according to an embodiment of the present invention.

FIG. 13 is a flow chart showing a method of determining the condition of the nozzles in an array type inkjet printer according to an embodiment of the present invention.

The controller 340 operates the printing part 310 to print a plurality of test patterns on the print medium 200. The plurality of test patterns includes first to fifth test patterns 400-800 of different forms as shown in FIG. 3. The fourth and fifth test patterns 700 and 800 are not necessarily included (S900). After the printing part 310 finishes printing, the controller 340 operates the scanning part 320 to scan the plurality of test patterns and to generate an image for the plurality of test patterns (S910). The controller 340 measures a distance between lines within the head chip 100 using the first test pattern 400 among the image for the plurality of test patterns. The distance between lines within the head chip 100 can be measured in the manner described with reference to FIG. 4 (S920). The controller 340 determines the scanning magnification using the measured distance between the chips (S930) and the beginning location for an image. The beginning location may be determined as described above with reference to FIG. 10. In some cases, the center location or the end location may be determined (S940). The controller 340 then determines the condition of the nozzles. In this case, levels of a plurality of nozzles or the results of determining whether the vertical pattern 520 of the second test pattern 500 is printed may be used. The condition of the nozzles may be determined as described above with reference to FIGS. 6-9 (S950). The controller 340 stores the information on the condition of nozzles in the cartridge storage 314. The nozzle information is stored in the head cartridge 100, not in the storage 330, so the nozzle information can be more efficiently used (S960).

As is described above, an array type inkjet printer, according to aspects of embodiments of the present invention and a method of determining the condition of nozzles in the array type inkjet printer do not only detect dead nozzles but also provide more specific information on nozzles.

As may be appreciated from the above description, an array type inkjet printer according to aspects of embodiments of the present invention and a method of determining the condition of nozzles in the array type inkjet printer may easily determine the operating condition of nozzles in the case of having a plurality of head chips with a plurality of nozzles.

Additionally, by using various test patterns, a distance between chips may be easily measured and scale correction of the scanned image is easy.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An array type inkjet printer, comprising:

a plurality of head chips, each comprising a plurality of nozzles;

a print part which prints a plurality of test patterns of different forms;

a scanning part which scans the plurality of printed test patterns; and a controller which controls the print part to print the plurality of test patterns using nozzles of interest from among the plurality of nozzles, and which determines the condition of the nozzles of interest with reference to a certain part of the scanned test patterns;

wherein the plurality of test patterns comprises:

a first test pattern comprising a plurality of vertical lines separated by a first constant interval;

a second test pattern comprising a horizontal pattern and a vertical pattern, the horizontal pattern comprising a plurality of horizontal lines, and the vertical pattern formed below the horizontal pattern and comprising a plurality of vertical lines separated by a second constant interval, the combination of the horizontal pattern and the vertical pattern repeating as many times as a length of the second interval; and a third test pattern comprising a plurality of vertical lines separated by the first constant interval, and formed to a side of the second test pattern.

2. The array type inkjet printer according to claim 1, wherein the controller controls the print part to print the first test pattern using nozzles of the plurality of head chips, and then prints the second and the third test patterns below the first test pattern using nozzles of a pair of neighboring head chips.

3. The array type inkjet printer according to claim 1, wherein the controller controls the print part to print the first test pattern by repeatedly using a center nozzle and two nozzles on either side of the center nozzle separated from the center nozzle by intervals having lengths which are substantially equal to a number of the plurality of head chips, and to print the second test pattern by using the plurality of head chips in turn in which the horizontal pattern is printed first by using all the nozzles of the used head chips, and the vertical pattern is then printed by using the nozzles at intervals which are positioned below the horizontal pattern, and to print the third test pattern simultaneously with the printing of the second test pattern, by using the head chips which are not used in the printing of the second test pattern, and by using the nozzles located at positions that correspond to those of the nozzles used in the printing of the first test pattern.

4. The array type inkjet printer according to claim 1, wherein the plurality of test patterns further comprises a fourth test pattern comprising a horizontal line which is formed by using color nozzles provided to the plurality of the head chips.

5. The array type inkjet printer according to claim 1, wherein the plurality of test patterns further comprises a fifth test pattern comprising a square which is formed by using a center nozzle and nozzles separated by predetermined distances from the center nozzle of the plurality of the head chips.

6. The array type inkjet printer according to claim 1, wherein the controller measures a distance between lines of one head chip using the first test pattern of the scanned test patterns, determines a scan rate based on the measured distance between the lines of one head chip, and determines a beginning location of the lines based on the determined scan rate.

7. The array type inkjet printer according to claim 6, wherein the controller detects the lines of the first test pattern within a line recognition range, determines a position mode based on the detected lines, determines location of centers of the head chips based on the position mode, and measures a distance between the head chips using the centers of the head chip and another head chip.

8. The array type inkjet printer according to claim 7, wherein the position mode comprises a center mode, a left mode and a right mode.

9. The array type inkjet printer according to claim 6, wherein the controller determines an operational status of the nozzles of interest using a level value of the plurality of nozzles when the image of the scanned test pattern is moved from the beginning location.

10. The array type inkjet printer according to claim 6, wherein the controller determines the operational status of the nozzles of interest by determining whether the vertical pattern within a range of the beginning location and a reference location are printed.

11. A method of determining conditions of nozzles to eject ink toward a print medium in an array type inkjet printer comprising a plurality of head chips on which the nozzles are disposed, the method comprising:

printing a plurality of different test patterns;

scanning the plurality of printed test patterns; and determining the condition of nozzles of interest with reference to a certain part of the scanned printed test patterns;

wherein the plurality of test patterns comprises:

a first test pattern comprising a plurality of vertical lines separated by a first constant interval;

a second test pattern comprising a horizontal pattern and a vertical pattern, the horizontal pattern comprising a plurality of horizontal lines, and the vertical pattern comprising a plurality of vertical lines separated by a second constant interval, the combination of the horizontal pattern and the vertical pattern repeating as many times as a length of the second interval; and a third test pattern comprising a plurality of vertical lines separated by the first constant interval, and formed to a side of the second test pattern.

12. The method according to claim 11, wherein the printing of the plurality of test patterns comprises:

printing the first test pattern using the nozzles of the plurality of head chips; and printing the second and the third test patterns below the first test pattern using the nozzles of a pair of neighboring head chips.

13. The method according to claim 11, wherein the printing of the plurality of test patterns comprises:

repeatedly printing the first test pattern by using a center nozzle and two nozzles on either side of the center nozzle separated from the center nozzle by intervals having lengths substantially equal to a number of the plurality of head chips;

printing the second test pattern by using the plurality of head chips in turn in which the horizontal pattern is printed first by using all the nozzles of the used head chips, and the vertical pattern is then printed by using the nozzles at intervals which are positioned below the horizontal pattern; and printing the third test pattern simultaneously with the printing of the second test pattern, by using the head chips which are not used in the printing of the second test pattern, and by using the nozzles at locations that correspond to the locations of the nozzles used in the printing of the first test pattern.

14. The method according to claim 11, wherein the plurality of test patterns further comprises a fourth test pattern comprising a horizontal line which is formed by using color nozzles provided to the plurality of the head chips.

15. The method according to claim 11, wherein the plurality of test patterns further comprises a fifth test pattern comprising a square which is formed by using a center nozzle and nozzles separated by predetermined distances from the center nozzle of the plurality of the head chips.

16. The method according to claim 11, further comprising determining a beginning location of the test patterns, the determining comprising:

measuring a distance between lines of one head chip using the first test pattern of the scanned test patterns;

determining a scan rate based on the measured distance between the lines of one head chip; and determining the beginning location based on the determined scan rate.

17. The method according to claim 16, wherein the measuring of the distance between the lines of one head chip comprises:

detecting the lines of the first test pattern within a line recognition range;

determining a position mode based on the detected lines;

determining centers of the head chips based on the position mode; and measuring a distance between the head chips using the centers of the head chip and another head chip.

18. The method according to claim 17, wherein the position mode comprises a center mode, a left mode and a right mode.

19. The method according to claim 16, wherein the determining of the condition of the nozzles of interest comprises determining an operational status of the nozzles of interest using a level value of the plurality of nozzles when the image of the scanned test pattern is moved from the beginning location.

20. The method according to claim 16, wherein the determining of the condition of the nozzles of interest comprises determining the operational status of the nozzles of interest by determining whether the vertical pattern within a range of the beginning location and a reference location are printed.

* * * * *